US006334448B1

(12) United States Patent
Kuo

(10) Patent No.: US 6,334,448 B1
(45) Date of Patent: Jan. 1, 2002

(54) POISON-REDUCED CIGARETTE

(76) Inventor: Dai-Ming Kuo, 5F, No. 226, Min-Chuan Road, Panchiao, Taipei Hsien (TW)

( * ) Notice: Subject to any disclaimer, the term of this patent is extended or adjusted under 35 U.S.C. 154(b) by 0 days.

(21) Appl. No.: 09/540,167

(22) Filed: Mar. 31, 2000

(51) Int. Cl.[7] ..... A24B 1/00; A24F 1/00
(52) U.S. Cl. ..... 131/360; 131/334; 131/200
(58) Field of Search ..... 131/334, 360, 131/200

(56) References Cited

U.S. PATENT DOCUMENTS 4,246,910 A * 1/1981 Rainer et al. ..... 131/10.9
4,350,173 A * 9/1982 Siren ..... 131/332

* cited by examiner

*Primary Examiner*—Christopher A. Fiorilla

(57) ABSTRACT

A poison-reduced cigarette includes adding hydrate of double salt of ferroso-ferric chloride into tobacco and cigarette filter to react with nicotine to form salt which will not be absorbed by the mucous membranes in the smoker's respiratory system for minimizing nicotine poison and for enhancing the smoker's health.

6 Claims, 1 Drawing Sheet

POISON-REDUCED CIGARETTE

BACKGROUND OF THE INVENTION

It is known that the nicotine contained in a cigarette smoke is harmful to a smoker's health. Several methods have been employed to remove the harmful constituents in the tobacco smoke such as by passing the tobacco smoke through a filter filled with fibrous material, charcoal or activated carbon. However, they are majorly physical adsorptions or absorphions, not chemical binding, thereby being not so effective for removing the hazardous poison materials in the tobacco smoke.

U.S. Pat. No. 5,048,546 disclosed a method for treating nicotine containing materials which involves adding to an adsorptional filter material of potassium aluminum sulfate or alum, $KAl(SO_4)_2$ in a quantity of 10~200 mg per cigarette for chemically binding nicotine in the tobacco smoke.

However, each cigarette still requires 10~200 mg of Alum, which will have a total amount of 200 mg~4 grams per box of 20 pieces of cigarette. Such a great amount of Alum, once being sucked into a smoker's respiratory system, may possibly dissolve large amount of aluminum into his or her blood. The high "dose" of aluminum may cause senile dementia to a heavy smoker. So, the addition of alum in a cigarette is not satisfactory and is still hazardous to the smoker's health.

The present inventor has found the drawbacks of the conventional methods for treating tobacco smoke, and invented the present poison-reduced cigarette and its filter.

SUMMARY OF THE INVENTION

The object of the present invention is to provide a posion-reduced cigarette including adding hydrate of double salt of ferroso-ferric chloride into tobacco and cigarette filter to react with nicotine to form salt which will not be absorbed by the mucous membranes in the smoker's respiratory system for minimizing nicotine poison and for enhancing the smoker's health.

DETAILED DESCRIPTION

Figure 1:
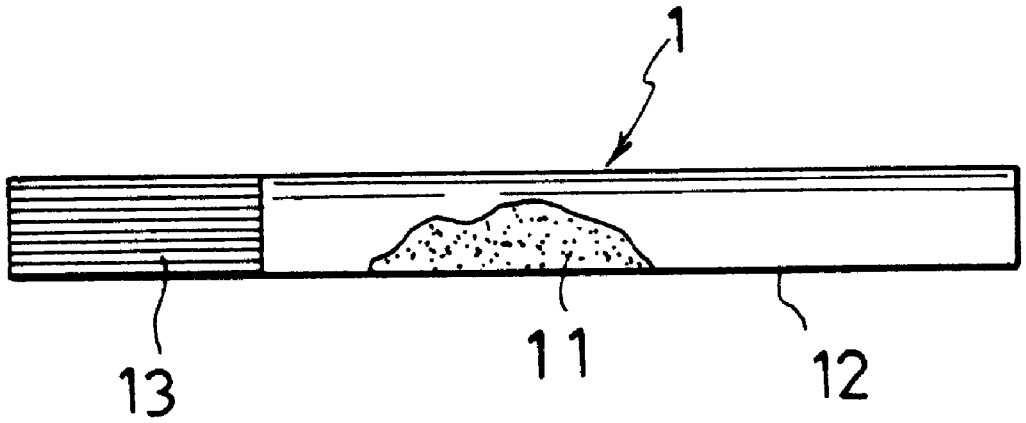
FIG. 1 is a partial cut-away illustration of the present invention.

As shown in FIG. 1, a cigarette 1 includes: sliced or shredded tobacco 11 wrapped in a cigarette paper 12 to form a tubular cigarette, and a filter 13 attached to one end portion of the cigarette. The filter 13 may be formed with fibrous materials including cellulose acetate, activated carbon, charcoal and is wrapped with paper.

The hydrate of double salt of ferroso-ferric chloride is dissolved in water to form an aqueous solution of 1 ppm of the double salt. The aqueous solution of ferroso-ferric chloride is then added into the tobacco by wetting, spraying, or other applying methods until obtaining the desired moisture content such as 11% of the cigarette. The excess of moisture is removed by drying and the tobacco treated with the ferroso-ferric chloride of the present invention is then wrapped. The filter 13 may also be treated by impregnating, coating, spraying or blending the hydrate of ferroso-ferric chloride into the fibrous or powder materials of the filter.

The ferroso-ferric chloride hydrate of the present invention has a general formula as follows:

$$mFeCl_2.nFeCl_3.xH_2O$$

wherein m, n and x are integers respectively. For instance, if m=1, n=2 and x=18, the following formula may be obtained:

$$FeCl_2.2FeCl_3.18H_2O$$

which can be decomposed to release hydrate water when heated above 50° C., and the hydrate is soluble in water either at cold or hot temperature.

The principle of the present invention, especially the mechanism to bind the nicotine with the hydrate of the ferroso-ferric chloride, is explained hereinafter:

1. When igniting a cigarette, the ignition temperature will decompose the hydrate of the ferroso-ferric chloride salt, and the ferric chloride and the ferrous chloride will be hydrolyzed as follows:

$$FeCl_2+H_2O=Fe(OH)_2+2HCl$$

$$FeCl_3+3H_2O=Fe(OH)_3+3HCl$$

2. The hydroxide of iron is a weak base, while the hydrochloric acid is a strong acid. So, the aqueous solution of the ferroso-ferric chloride will become acidic.
3. The nicotine in cigarette smoke has a formula of: 3-(1-Methyl-2-pyrrolidinyl) pyridine, which is a weak base and will react with the acidic aqueous solution of the hydrolized ferroso-ferric chloride salt as above-mentioned to form salt of neutralization.
4. The salt of nicotine thus formed, even not absorbed by the filter, will not be absorbed by the mucous membranes of the smoker's respiratory system, thereby minimizing or preventing poison by nicotine.

The concentration of ferroso-ferric chloride in the aqueous solution may range from 0.1~100 ppm, and is preferably 1 ppm. However, the concentration of the ferrso-ferric chloride is not limited in the present invention.

The ferroso-ferric chloride may also absorb carbon monoxide and tar existing in the tobacco smoke to minimize the poison as caused by the poisonous constituents in the tobacco smoke. Several cancerogenic chemicals in the tobacco smoke may not be ionized as inhibited by the ferroso-ferric chloride salt of the present invention to thereby prevent from the cancer hazard by tobacco smoke.

The amount of the chloride salt as used for treating the tobacco and the cigarette filter is so small (such as less than 1 ppm) in this invention, and therefore uninfluential to the smoker's health.

Several smokers are invited for testing the effect by smoking the cigarette treated with the ferroso-ferric chloride salt of the present invention in comparison with the effect by smoking the cigarette without being treated with the ferroso-ferric chloride salt of this invention. Then, an examination is taken for checking the nicotine concentration in the smoker's blood, indicating a reduction of nicotine content of 30~80% in the smoker's blood by treating the ferroso-ferric chloride salt than that without being treated with the ferroso-ferric chloride. Therefore, the present invention may reduce the nicotine content in the cigarette smoke to minimize nicotine hazard to be helpful for a smoker's health.

Figure 2:
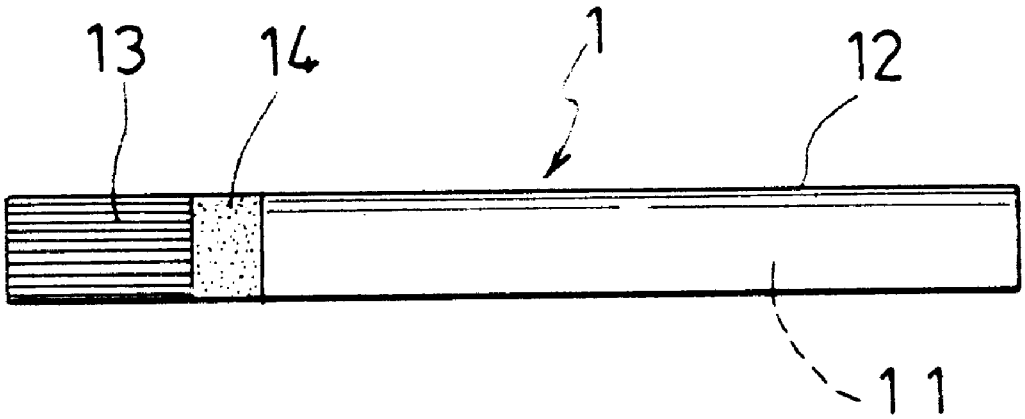
FIG. 2 shows another preferred embodiment of the present invention.

As shown in FIG. 2, a filter section 14 made of fibrous materials, cotton, foam or any absorbent materials is provided in the filter 13 for carrying or absorbing the hydrate of double salt of ferroso-ferric chloride of the present invention, such as by impregnation, spraying, coating, or any other absorption methods.

I claim:

1. A cigarette comprising:

a hydrate of ferroso-ferric chloride added into tobacco for binding nicotine in tobacco smoke for minimizing nicotine poison in a cigarette.

2. A cigarette according to claim 1, wherein said cigarette includes a filter added therein with a hydrate of ferroso-ferric chloride.

3. A cigarette according to claim 2, wherein said filter is impregnated, coated, absorbed and added therein with an aqueous solution of hydrate of ferroso-ferric chloride.

4. A cigarette according to claim 1, wherein said hydrate of ferroso-ferric chloride is dissolved in water to form an aqueous solution which is applied to tobacco by impregnation, spraying, wetting, absorption, and blending.

5. A cigarette according to claim 1, wherein said hydrate of ferroso-ferric chloride has a general formula of:

$$mFeCl_2.nFeCl_3.xH_2O,$$

wherein m, n and x is an integer.

6. A cigarette comprising:

a tubular cigarette having paper wrapping tobacco within the paper;

a hydrate of ferroso-ferric chloride added in the tobacco in said tubular cigarette; and a filter attached to said tubular cigarette, having a filter section made of absorbent materials inserted in said filter, and having a hydrate of ferroso-ferric chloride added and absorbed in said filter section.

* * * * *